US012202656B2

(12) United States Patent
Chen

(10) Patent No.: US 12,202,656 B2
(45) Date of Patent: Jan. 21, 2025

(54) CONTAINER AS GIFT BOX

(71) Applicant: JAST Gifts Shenzhen Company Limited, Shenzhen (CN)

(72) Inventor: Jen-Lin Chen, Cupertino, CA (US)

(73) Assignee: JAST Gifts Shenzhen Company Limited, Shenzhen (CN)

( * ) Notice: Subject to any disclaimer, the term of this patent is extended or adjusted under 35 U.S.C. 154(b) by 468 days.

(21) Appl. No.: 17/573,659

(22) Filed: Jan. 12, 2022

(65) Prior Publication Data

US 2023/0051608 A1 Feb. 16, 2023

(30) Foreign Application Priority Data

Aug. 13, 2021 (DE) ..... 20 2021 104 336.9

(51) Int. Cl.
*B65D 5/42* (2006.01)
*B65D 5/44* (2006.01)

(52) U.S. Cl.
CPC ..... *B65D 5/4258* (2013.01); *B65D 5/4291* (2013.01); *B65D 5/445* (2013.01); *B65D 2203/12* (2013.01)

(58) Field of Classification Search
CPC .... B65D 5/4258; B65D 5/4291; B65D 5/445; B65D 2203/12
(Continued)

(56) References Cited

U.S. PATENT DOCUMENTS 3,937,320 A * 2/1976 Chao ..... A45C 15/06 206/418
5,096,058 A * 3/1992 Juravin ..... B65D 5/422 283/117

(Continued)

FOREIGN PATENT DOCUMENTS

AU 199722730 9/1997
CH 661022 6/1987

(Continued)

*Primary Examiner* — Rakesh Kumar

(57) ABSTRACT

The invention relates to a container for accommodating one or more objects, with the container having a main body and a lid, with the main body having a bottom as well as side walls forming a border structure pointing towards the lid, with the container having a connecting edge via which the main body and lid are pivotably connected to one another, wherein the container is provided with a unfoldable figure which is reversibly transferable from a compressed flat state to a three-dimensional expanded state, and means for producing visual and/or acoustic effects, wherein the container has a foldable insert sheet that has at least five sections arranged one behind the other in the longitudinal direction, the 1st section covering the inner side of the lid, the 2nd and 5th sections, laid one on top of the other, being placed into the main body and the 3rd and 4th sections, laid one on top of the other, resting against the inside of the side wall opposite the connecting edge, wherein between the bottom and the 2nd and 5th sections laid one on top of the other there is a compartment formed out for receiving the objects, with means for producing visual and/or acoustic effects being located between the inside of the lid and the 1st section, and the unfoldable figure being located between the 1st and 2nd sections.

20 Claims, 13 Drawing Sheets

(58) Field of Classification Search
USPC ..... 221/282
See application file for complete search history.

(56) References Cited

U.S. PATENT DOCUMENTS

| | | | | | |
|---|---|---|---|---|---|
| 5,226,532 | A * | 7/1993 | Davidson | B65D 5/4229 | 229/242 |
| 5,289,917 | A * | 3/1994 | Chabria | B65D 5/5088 | 206/232 |
| 5,293,994 | A * | 3/1994 | Antik | G11B 23/40 | |
| 5,497,876 | A * | 3/1996 | Fleming | B65D 5/6602 | 206/45.28 |
| 5,738,221 | A * | 4/1998 | Van Witt | G11B 23/40 | |
| 6,868,964 | B2 * | 3/2005 | Carty | B65D 5/541 | 206/45.29 |
| 2018/0072086 | A1 * | 3/2018 | Mayer | B42D 15/045 | |

FOREIGN PATENT DOCUMENTS

| | | | | |
|---|---|---|---|---|
| CH | 661022 | A5 * | 6/1987 | B65D 79/02 |
| CN | 111056125 | | 4/2020 | |
| CN | 111056125 | A * | 4/2020 | B42D 15/042 |
| CN | 211686174 | | 10/2020 | |
| DE | 202006016582 | | 2/2007 | |
| DE | 202006016582 | U1 * | 2/2007 | B65D 5/4212 |
| WO | WO-0052680 | A1 * | 9/2000 | G10H 1/26 |

* cited by examiner

CONTAINER AS GIFT BOX

RELATED APPLICATION

This application claims the benefit of priority of Germany Patent Application No. 20 2021 104 336.9 filed on Aug. 13, 2021, the contents of which are incorporated herein by reference in their entirety.

FIELD AND BACKGROUND OF THE INVENTION

The invention relates to a container designed so as to accommodate one or several objects, with the container comprising a main body and a lid, the main body being provided with a bottom as well as side walls which are forming a border structure pointing towards the lid, the container further having a connecting edge where the main body and lid are joined to each other in a pivotable manner, with the container also being provided with an unfoldable figure that can be reversibly transferred from a compressed flat state to a three-dimensional expanded state, and means capable of generating visual and/or acoustic effects.

With a view to presenting and handing over a gift to a recipient in an appealing manner, containers serving as gift boxes or gift packaging are known, as for example disclosed in publication DE 20 2006 016 582 U1. On the one hand, gift boxes of this type must be provided with a compartment for accommodating the gift, for example, a book or the like, but it may also be desirable if they feature additional effects. The effects so produced may be of acoustic nature, for example the playing of a melody such as a birthday, wedding or Christ-mas song. In addition to or in lieu of the acoustic effects generated, visual effects may also be produced, particularly by means of using LEDs capable of producing a flashing frequency.

Another effect which, in principle, has been known from the prior art and can additionally be produced by a gift box concerns a reversibly foldable and unfoldable three-dimensional figure. Three-dimensional figures of this nature are also frequently found in connection with greeting cards. When the greeting card or gift box is opened, the figure unfolds thus forming into a three-dimensional expanded state and may represent a specific object, preferably an object that is appropriate for the occasion or meaningful to the person receiving the gift. Typical three-dimensional objects are wedding cakes, bridal couples, cars and the like.

In principle, relevant containers that can be used as gift boxes are already known, but their design and manufacture have so far been comparatively sophisticated. Due to the fact that this is an everyday article or item which needs to be cost-efficiently manufactured, the objective therefore calls for the provision of an appropriate container that has a purposeful, suitable structure and can moreover be produced in a simple manner.

SUMMARY OF THE INVENTION

As proposed by the present invention, this objective is accomplished by a container designed so as to accommodate one or several objects, with the container comprising a main body and a lid, the main body being provided with a bottom as well as side walls which are forming a border structure pointing towards the lid, the container further having a connecting edge where the main body and the lid are joined to each other in a pivotable manner, with the container also being provided with an unfoldable figure that can be reversibly transferred from a compressed flat state to a three-dimensional expanded state, and means capable of generating visual and/or acoustic effects, with the container being provided with a foldable insert sheet comprising at least five sections longitudinally arranged one behind the other, wherein

- the 1st section covers the inside of the lid,
- the 2nd and 5th sections are placed on top of each other in the main body and
- the 3rd and 4th sections are laid one on top of the other against the inside of the side wall opposite to the connecting edge, with a compartment for the accommodation of the objects being formed between the bottom and the 2nd and 5th sections placed on top of one another, with means for producing visual and/or acoustic effects being located between the inside of the lid and the 1st section, and the unfoldable figure being arranged between the 1st and 2nd sections.

The fact that a single insert sheet is sufficient to provide an otherwise conventional container with all the functionalities desired for a gift box is to be regarded as a special advantage of the invention. The foldable insert sheet is an elongated strip of approximately the same width as the container or slightly smaller so that it can be inserted into the lid and main body. Viewed in the longitudinal direction, the insert sheet consists of a 1st, a 2nd, a 3rd, a 4th and a 5th section which are arranged one behind the other. Said insert sheet is in most cases made of thick paper or cardboard material.

Whereas the size of the 1st, 2nd and 5th sections is normally largely the same and coincides in this respect with the area of the container bottom or lid, the width of the 3rd and 4th sections is identical to that of the other sections but in terms of length these sections are essentially similar to the height of the container. As a rule, the container is of cuboidal shape, mostly is a flat cuboid, with the width and depth significantly exceeding the height. Accordingly and viewed in the longitudinal direction, the 3rd and 4th sections are considerably shorter than the 1st, 2nd and 5th sections. The length of the 3rd and 4th sections is substantially identical to or slightly less than the height of the container, which means the 3rd and 4th sections can be placed against the inside of one of the side walls of the main body.

As mentioned hereinbefore, the container proposed by the invention is usually a cuboid that has a rectangular base area. The insert sheet width is sized so as to match the width of the container, with the width of the insert sheet normally being the same across all of the sections. The length of the 1st, 2nd and 5th sections is essentially equal to the vessel depth, with the length of the 3rd and 4th sections being identical to the vessel height. However, it must al-ways be born in mind that the respective sections of the insert sheet should be slightly smaller than the relevant dimensions of the container to enable the various sections of the insert sheet to be easily placed into or fit against the respective sections of the container.

Even though the insert sheet width remains basically constant in principle over the entire length of the insert sheet, there are individual sections that may have additional areas at the longitudinal end or arranged at the side that could be folded over. This is particularly true for the 1st section, which is placed against the inside of the lid. In the event the lid itself has a surrounding border, these foldable areas can be placed against the inner surfaces of the border and fixed there if necessary.

An additional bendable section may abut against the top side foldable area. This additional bendable section preferably has the same width as the other sections. The length typically corresponds to the length of the 1st section. Typically the additional bendable section is an integral part of the insert sheet, however, it may also be attached as a separate part to the insert sheet. Upon folding the insert sheet the additional bendable section covers the 1st section so that an interspace is generated. The 1st section and the additional bendable section are placed within the lid of the container wherein the top side foldable area defines the height of the interspace. The interspace generated this way is usable for accommodation of electronic components like the means for generating the optical and/or acoustic effects.

The container itself is of a basically customary design with a main body provided with a bottom as well as side walls forming a border structure around the bottom. Moreover, the container is also provided with a lid, said lid may also have a border structure, which in this case points in the direction of the bottom; nevertheless, it is also conceivable to use a flat lid. However, a lid provided with a border offers advantages in that the available space within the lid being in-creased in this manner, said space thus being available to accommodate the means for generating the visual and/or acoustic effects.

The lid and the main body are joined to each other along a connecting edge, that is, the lid can be folded open along the connecting edge. The connection is designed so as to be pivotable, in particular one or more hinges can be provided here.

The different areas of the container interior are separated from each other by means of the insert sheet. The 1st section of the insert sheet covers the inside of the lid and is inserted into it in the event of a lid provided with a surrounding border. The following sections are each folded over along edges extending between the respective sections with respect to the adjacent sections. The 3rd and 4th sections are folded around 180° towards each other so that the reverse sides of the 3rd and 4th sections come to rest against each other. The 3rd and 4th sections can be fixed to each other along the reverse sides, for example by gluing/bonding and in this way form a common double layer. Correspondingly, the reverse sides of the 2nd and 5th sections can then also be arranged against each other, with the 2nd/5th section now forming a right angle with the 3rd/4th section. Thus, the 2nd and 5th sections are also arranged so as to form a common double layer. In this configuration, the insert sheet from the 2nd to the 5th section can be placed into the main body, with the 3rd and 4th sections ensuring that the 2nd and 5th sections are spaced away from the bottom of the main body. The compartment of the container created in this manner serves to accommodate objects, in particular the gift, when the container is used as a gift box. The 2nd and 5th sections as well can be fixed to each other along the reverse sides, for example by gluing. The compartment designed to hold objects can be opened by folding out the 2nd to 5th sections together, i.e. lifting them out of the main body.

The unfoldable figure is situated between the 1st and 2nd sections in such a manner that it independently assumes its three-dimensional expanded form as soon as the 1st section is moved away from the 2nd section, which is the case when the lid of the container is opened. When the lid is closed again, the 1st and 2nd sections are brought together again causing the three-dimensional figure to return to its flat, compressed state.

The 1st section of the insert sheet is placed into the lid in such a way that an interspace is created between the inside of the lid and the 1st section, which enables means for the generation of the visual and/or acoustic effects to be accommodated in this space. For example, these means may be located on the rear side of the 1st section. In case the insert sheet has an additional bendable section adjacent to the top side foldable area, these means may also be located on the rear side of this additional bendable section. These means are the required electrical and electronic components of the container including, in particular, a voltage source, a loudspeaker, an integrated circuit, a printed circuit board, illuminants such as LEDs, resistors, etc. It shall nevertheless not be ruled out that individual electrical or electronic components may also be arranged in another area of the container, in particular the visual effects producing LEDs. In particular, at least individual electrical and/or electronic components may also be mounted on the reverse side of the 2nd section, that is, between the 2nd and 5th sections. Normally however, the control unit that operates the visual and/or acoustic effects is interposed between the inside of the lid and the 1st section of the insert sheet. Preferably, most of the electrical and electronic components are arranged on a printed circuit board.

A further option would be to provide means for the initiation of motion effects by means of which parts of the unfoldable figure are allowed to move when the container is opened. Such motion effects are typically brought about via the same control unit that operates the visual and/or acoustic effects. The means for actuating said motion effects can be, for example, a small electric motor or a spring activated by the control unit or via a switch. Part of the unfoldable figure can be set into a swinging motion by means of a spring.

Typically, the insert sheet consists of thick, usually single-ply paper or cardboard, as these are materials that are readily available, inexpensive and capable of being easily formed into the desired/appropriate shape. It is, in principle, also conceivable, however, to manufacture the insert sheet using for instance plastic material or a thin metal sheet.

The 1st section of the foldable insert sheet may be bonded at least partially to the inside of the lid. This enables a secure and permanent fixation to the lid to be achieved. Due to the fact that electronic components are accommodated between the inside of the lid and the 1st section, it is often sufficient to bond, for example, only the edge area of the 1st section to the inside of the lid in order to bring about fixation in this way on the one hand, but on the other hand to leave sufficient space for the means needed to produce the visual/acoustic effects.

The 1st section may have an opening through which a switch extends which is used to activate or deactivate the means for generating the visual/acoustic effects and, as the case may be, motion effects. The switch is configured in such a way that said means are activated when the container is opened and deactivated when the container is closed. This means that, when the lid is opened, the playback of the visual/acoustic effects starts, for example, in the form of playing a melody or producing light effects. For example, the switch may interact with the 2nd section and is thus actuated depending on the distance created between the 1st and 2nd sections. In particular, a simple pushbutton switch may be used for this purpose that is activated or deactivated as a function of the opening state of the lid. It goes without saying that the switch must be connected to and interact with the other components provided to create the visual/acoustic effects.

Alternatively, the control of the means for producing the effects can also be achieved via a reed contact. To this effect, a reed contact is arranged in the area of the 1st section, for instance between the inside of the lid and the 1st section of the insert sheet, with a magnet being located in the area of the 2nd section, for instance between the 2nd and 5th sections of the insert sheet, with a vice versa configuration also being conceivable. When opening or closing the container the distance between the reed contact and the magnet increases respectively decreases resulting in an activation or deactivation of the means for generating the visual/acoustic effects and, if applicable, the motion effects. The reed contact and the magnet may also be located at alternative points of the container that change their positions depending on whether the lid is open or closed. For example, a magnet can be located at the opening edge of a side wall of the main body while the reed contact is attached to the lid or vice versa.

Illuminating means are expediently arranged between the 1st section of the insert sheet and the inside of the lid and/or between the 2nd and 5th sections of the insert sheet, said means being electrically connected to the means for producing the visual effects. To enable the visual effects being visible to the surrounding environment, cutouts are provided in the 1st and/or 2nd section to allow the light that is generated by the illuminants to pass through. Optionally, the 1st and/or 2nd section can be designed so as to be at least partially trans-parent. Typically, the illuminating means are LEDs, as they are particularly small and their energy consumption is low. Viewers thus perceive the produced visual effects as soon as they open the container, which is due to the fact that the pivoting of the lid relative to the main body brings about an activation of the aforesaid means for generating the visual/acoustic effects.

Moreover, the 1st and 2nd sections of the insert sheet are provided expediently with cutouts for securing the unfoldable figure. As is first mentioned above, said figure is located between the 1st and 2nd sections and is configured so as to automatically unfold upon opening of the container and return to its compressed, flat shape when the container is closed. In most cases, the unfoldable figure is arranged on the insert sheet as a separate element, but it may also be formed as part of the insert sheet itself. By securing parts of the unfoldable figure to the cutouts provided in the 1st section, the respective parts of the figure are thus moved away from the remaining parts of the figure when the lid is opened which causes the three-dimensional figure to unfold. Appropriate folding techniques are generally known in the field of greeting cards. It is also possible to connect the unfoldable figure permanently to the 1st and 2nd sections.

Between the individual sections, orthogonal to the longitudinal direction of the insert sheet, areas can be provided that facilitate the folding of the insert sheet. This applies in particular to the area between the 1st and 2nd sections since, unlike at the boundaries between the other sections, movement occurs every time the lid is opened and closed. For example, said area may be provided with 2 to 4 notches or grooves that allow buckling and folding with reduced force and in this manner bring about additional flexibility in movement.

In particular, as stated hereinbefore, the lid itself may be provided with side walls forming a border structure facing toward the bottom. The lid in this case is not simply flat, but has a certain height brought about by the border. Accordingly, the 1st section of the insert sheet can be placed into the lid. Moreover, the border structure ensures that the lid features a height that allows the accommodation of electronic components for producing visual/acoustic effects.

Adjacent to the connecting edge at which the main body and the lid are pivotably connected to one another, reinforcing strips can be inserted into both the lid and the main body parallel to the connecting edge. These reinforcing strips, for example, consist of relatively thick cardboard strips. Typically, the length of these strips corresponds to the width of the container inside and the strip height approximately matches the height of the main body or the height of the lid. Said strips can thus be placed into the lid or the main body, with the reinforcing strips being automatically secured, so that an additional fixation is usually not required. Nevertheless, additional fixation measures can be taken, such as bonding the reinforcing strips to the side walls of the lid/main body abutting the connecting edge. As a result, both reinforcing strips extend parallel to the connecting edge. Providing reinforcing strips serves to increase the stiffness of the main body and lid.

The reinforcing strip placed in the lid may also be provided to accommodate the switch that activates and deactivates the means for producing the visual and/or acoustic effects when the container is opened and closed. For this purpose, the reinforcing strip placed into the lid may have a cutout through which the relevant switch projects. When the container is closed, said switch contacts areas of the main body such as the side wall adjacent to the connecting edge or the reinforcing strip placed into the main body which causes it to be actuated, resulting in a deactivation of the means arranged to produce the effects. As soon as the lid is opened, the actuation of the switch will no longer be effective resulting in the means for generating the effects to be activated.

The reinforcing strip placed in the lid may also be part of an insert, preferably an L-shape insert, that can be made from paper material, particularly structured paper material. The insert can be fixed to the inside of the lid. Means for producing visual and/or acoustic effects, preferably all electronic means of the container including the switch may be located at the insert. Hence, the electronic components of the container, including a PCBA (printed circuit board assembly) are part of a separated insert that is fixed to the lid. As described before the reinforcing strip may accommodate the switch, i.e. in a recess or cutout in the strip.

For the purpose of limiting the opening angle between lid and main body, a band, cord or similar item can be fitted between the lid and the main body. In this way, for example, the opening angle can be restricted to 90 to 110°, for example 100°, bearing in mind that without the provision of a band/cord a complete opening angle of 180° would be possible, which might not be a necessarily desirable option. By opening the lid in this manner, a configuration of the container is ensured that enables the unfoldable figure to be most appropriately displayed. Since the three-dimensional configuration of the unfoldable figure depends on the opening angle created between the lid and the main body, it is advisable and useful to limit the opening angle.

To make sure that the lid can be pivoted relative to the main body of the container, the connecting edge is expediently provided with one or more hinges, which allows the container to be repeatedly opened and closed without difficulty.

An additional reinforcing sheet may be placed between the 2nd and 5th sections, which are arranged in the main body parallel to the bottom of the main body. This reinforces the stiffness of the 2nd and 5th sections and enables the user to write on the 2nd or 5th section, for example, adding a greeting message to the recipient of the gift.

In order to allow the recipient of the gift to easily open the compartment to have access to the items it contains, in particular the gift, a pulling element may be attached to the 2nd or 3rd section, which the user may grasp. For example, such a pulling element can be a small loop that must be pulled to open the compartment containing the items to be given away. The compartment is closed again by pushing the 2nd to 5th sections back into the main body.

Further elucidation of the invention is provided by way of examples through the enclosed figures. It is to be noted that the figures show preferred embodiment variants of the invention, with the invention itself not being limit thereto. To the extent it is technically expedient, the invention comprises, in particular, any optional combinations of the technical features that are stated in the claims or in the description as being relevant to the invention.

BRIEF DESCRIPTION OF THE SEVERAL VIEWS OF THE DRAWINGS

Details of the invention are shown in the following figures where.

DESCRIPTION OF SPECIFIC EMBODIMENTS OF THE INVENTION

Figure 1:
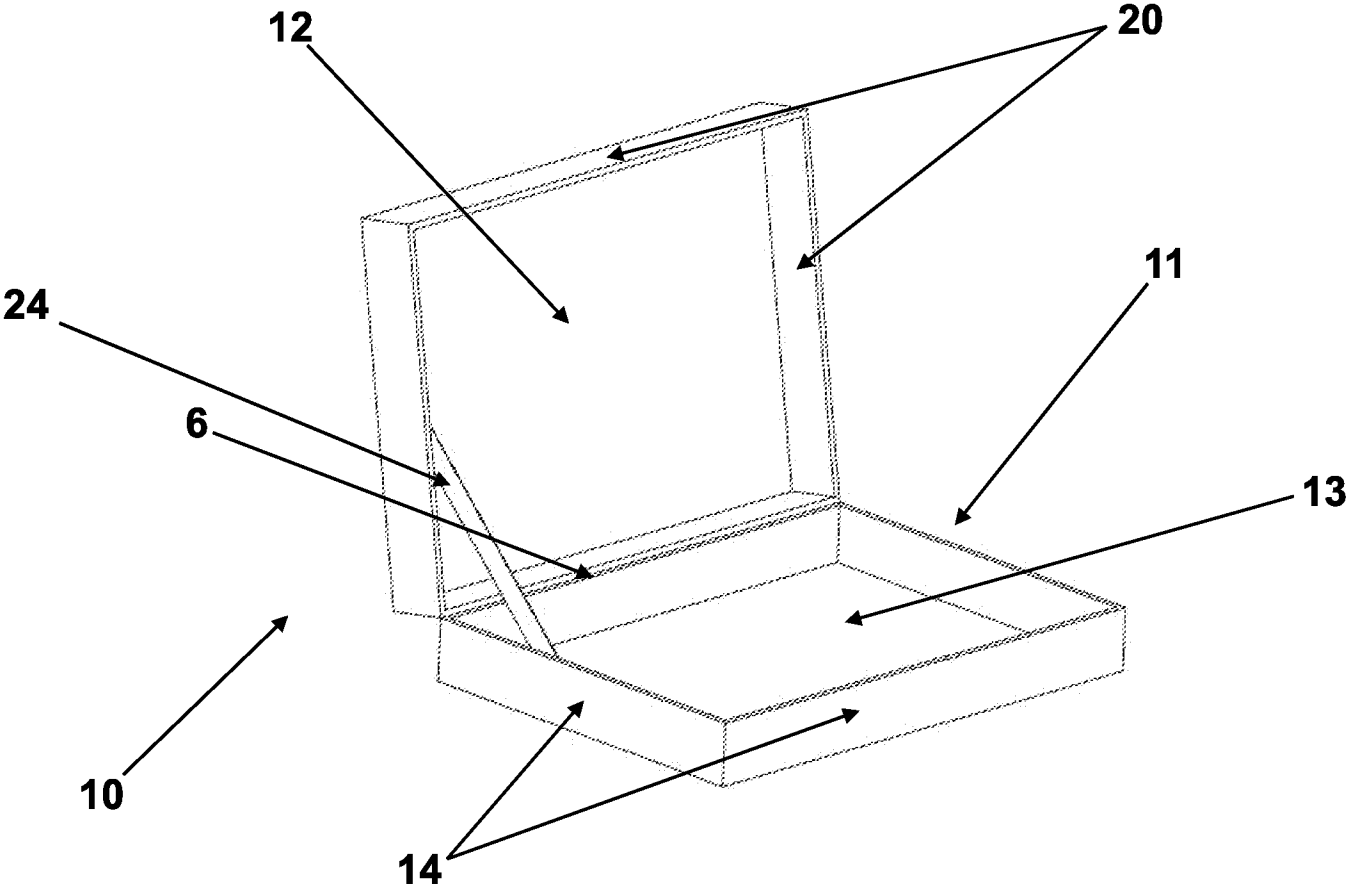
FIG. 1 illustrates an oblique view of a container proposed by the invention.

In FIG. 1, the invention is represented in the form of an inclined top view. The container 10 consists of a main body 11 and a lid 12, with the main body 11 being composed of a bottom 13 and side walls 14. In the embodiment illustrated here, the lid 12 also has side walls 20, with lid 12 and main body 11 being pivotably connected to each other along a connecting edge 6. The opening of the container 10 is limited by means of band 24.

Figure 2A:
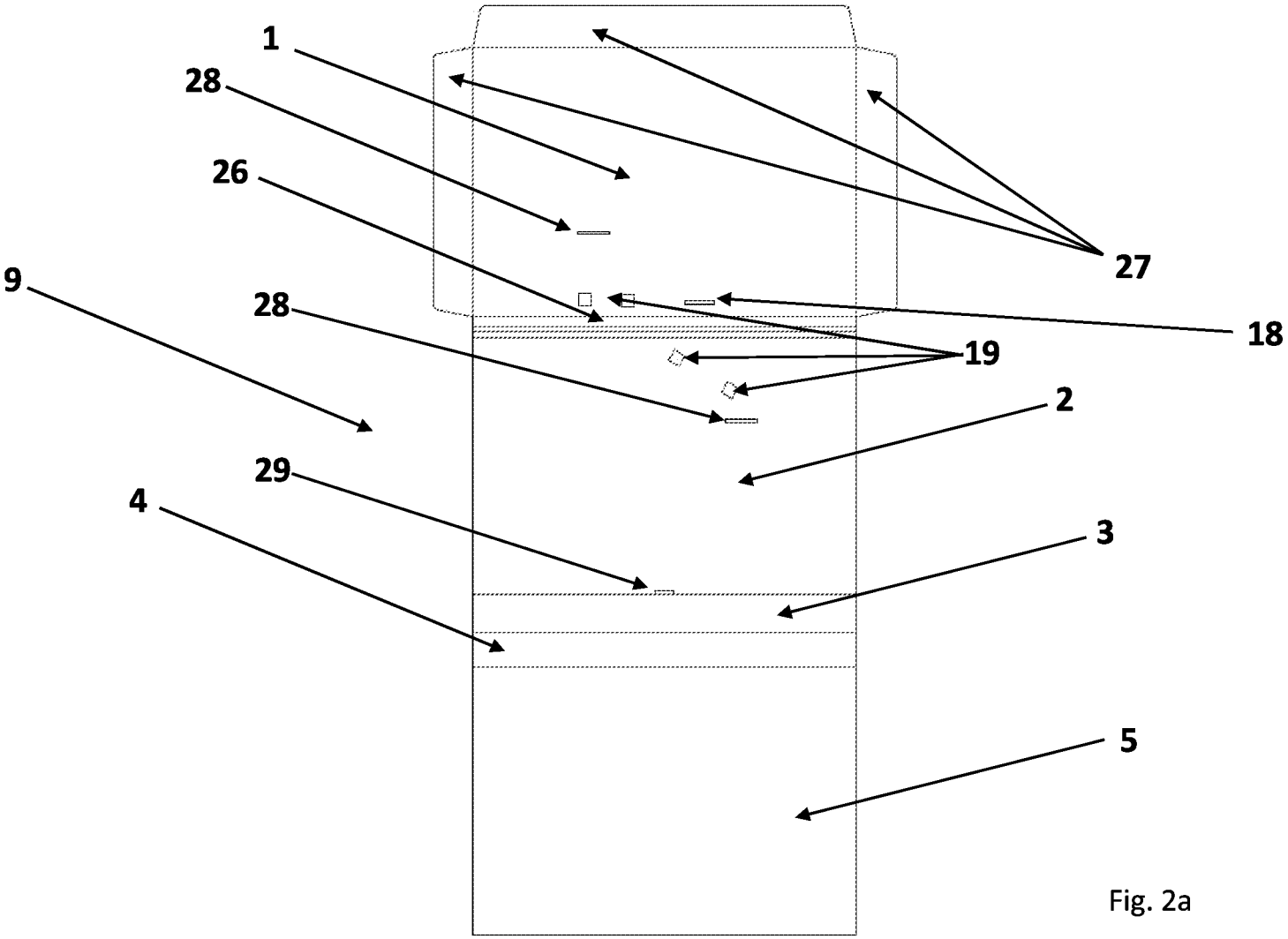
FIG. 2*a* is a top view of the insert sheet in the unfolded state.

In a top view illustration, FIG. 2*a* shows the insert sheet 9 in its unfolded state. Insert sheet 9 has five sections 1, 2, 3, 4 and 5, which are arranged one behind the other in the longitudinal direction. With the exception of the foldable areas 27 provided laterally in the area of the 1st section 1, the width of the insert sheet 9 is constant over its entire length. In contrast, the 1st, 2nd and 5th sections 1, 2 and 5 are significantly longer than the 3rd and 4th sections 3 and 4, which is related to the fact that, in the inserted state, the 1st section 1 is positioned against the inner side of the lid 12 and the 2nd and 5th sections 2, 5 rest on the bottom 13 of the main body 11, whereas the 3rd and 4th sections 3, 4 are placed against a side wall 14 of the main body 11. In the event that the container 10 is designed as a flat cuboid, this results in a significantly reduced length for the 3rd and 4th sections 3, 4 in comparison to the other sections 1, 2 and 5.

Furthermore, various cutouts can be seen in the insert sheet 9. Opening 29 serves to pass through a pulling element by means of which the compartment can be opened with a view to accommodating objects, in particular gifts. The cutouts 28 are intended to secure the foldable figure which is to be mounted on the insert sheet 9. A switch to be provided for the activation of the visual/acoustic effects is passed through cutout 18. Finally, the cutouts 19 are provided for LEDs located underneath to allow them to illuminate and shine through the insert sheet 9. To render the insert sheet 9 sufficiently flexible along the connecting edge 6 of the container 10 when the lid 12 of the container 10 is opened or closed, additional areas 26 are provided for the purpose of facilitating the folding of the insert sheet 9 in this area.

Figure 2B:
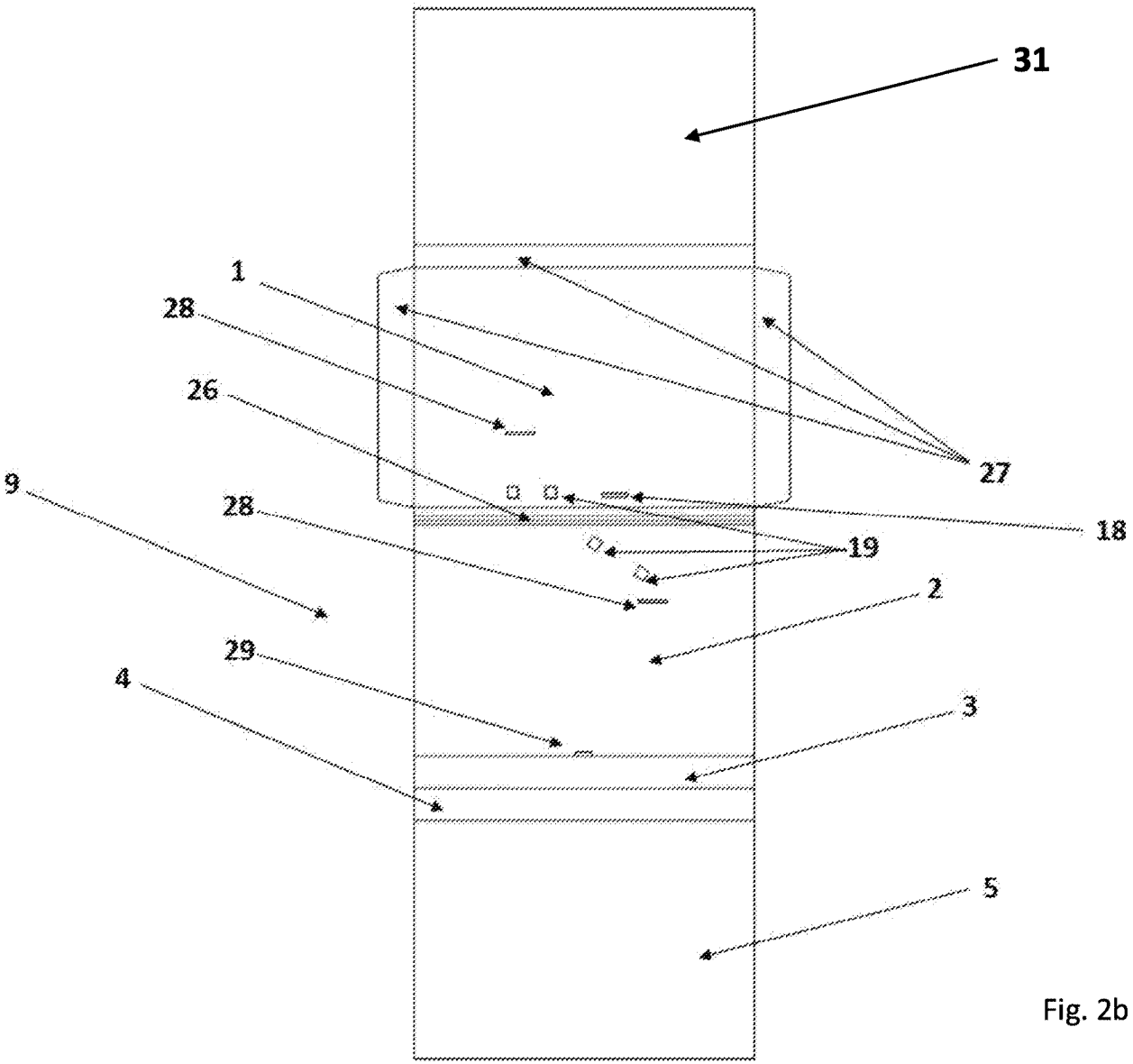
FIG. 2*b* is a top view of the insert sheet in the unfolded state according to an alternative embodiment.

FIG. 2*b* shows the view equivalent to FIG. 2*a* of an alternative embodiment wherein the insert sheet 9 comprises an additional bendable section 31 adjacent to the top side foldable area 27. When the insert sheet 9 is inserted into the lid 12, the additional bendable section 31 is folded towards the 1st section 1 wherein the top side foldable area 27 generates a certain height of the interspace between the additional bendable section 31 and the 1st section 1. This interspace may be used for accommodation of electronic components 8.

Figure 3B:
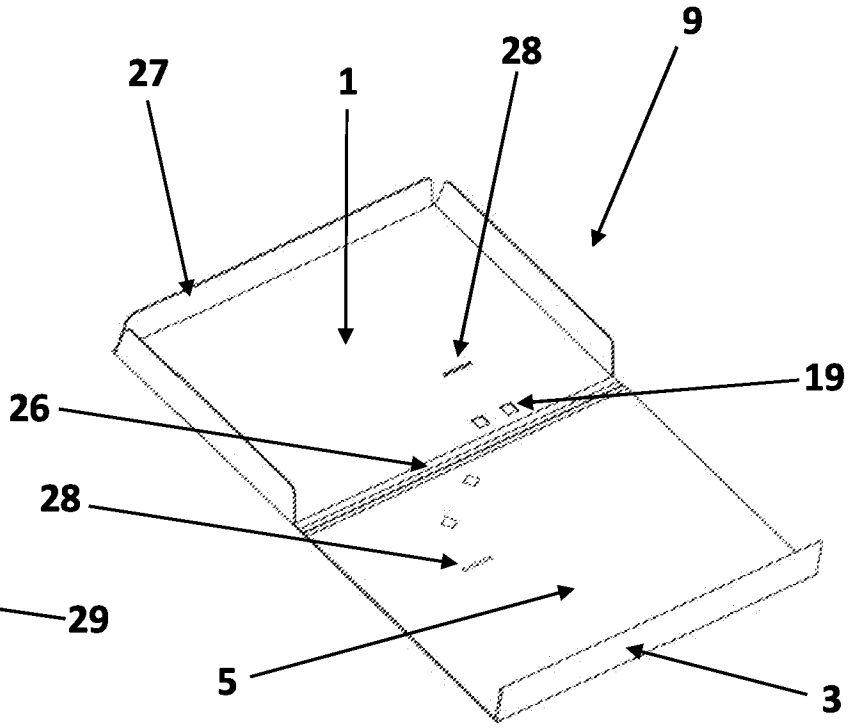
FIG. 3*b* shows the insert sheet in the folded state as seen from below.

As viewed from above in FIG. 3*a*, the insert sheet 9 is displayed in the folded state, while FIG. 3*b* is an illustration seen from below. Due to the folding of insert sheet 9, the 2nd and 5th sections 2, 5 are arranged on top of each other, and the same applies to the 3rd and 4th sections 3, 4. The 1st section 1, on the other hand, is provided as a single layer for placement into the lid 12.

Figure 3A:
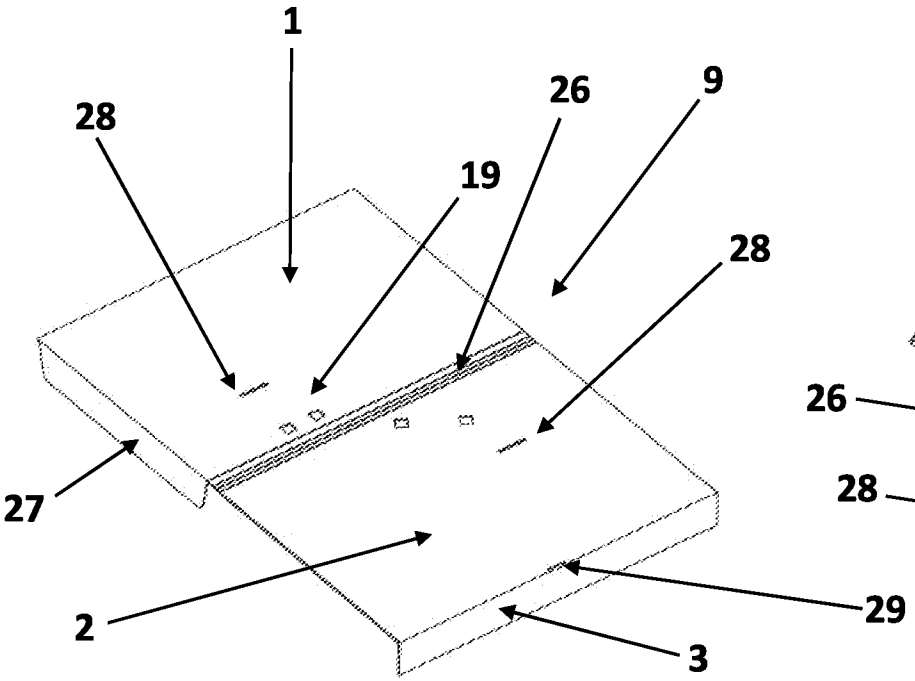
FIG. 3*a* shows the insert sheet in the folded state as seen from above.
Figure 3D:
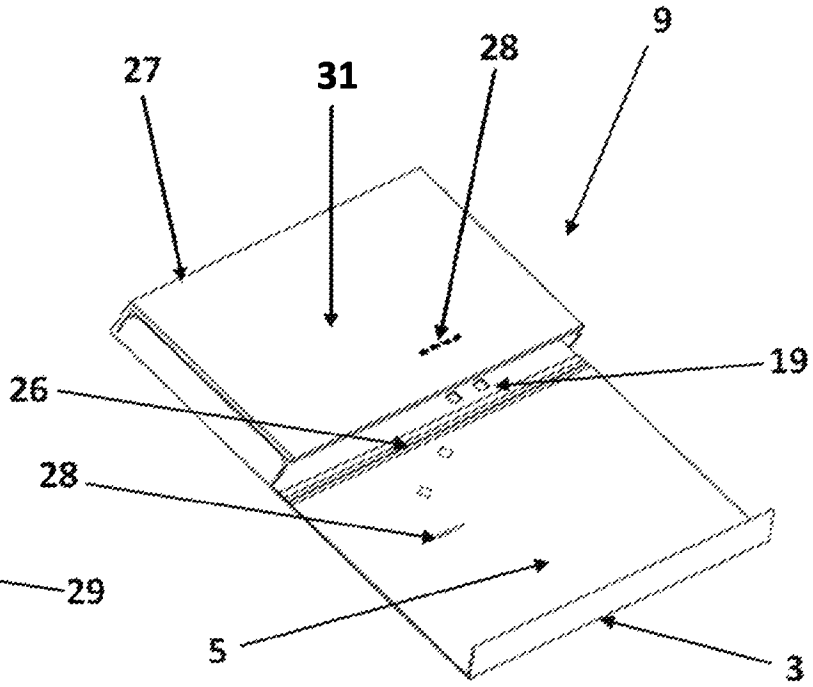
FIG. 3*d* shows the insert sheet of the alternative embodiment of FIG. 2*b* in the folded state as seen from below.
Figure 3C:
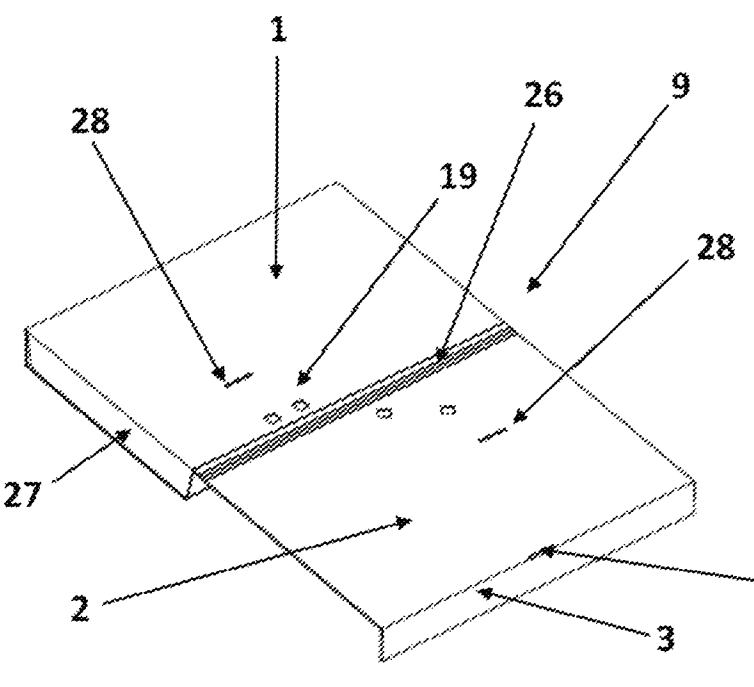
FIG. 3*c* shows the insert sheet of the alternative embodiment of FIG. 2*b* in the folded state as seen from above.

FIGS. 3*c* and 3*d* correspond to the FIGS. 3*a* and 3*b*, however, according to the alternative embodiment of the insert sheet 9 of FIG. 2*b*. The additional bendable section 31 is folded towards the 1st section 1. Electronic means for generating optical and/or acoustic effects 8 may be accommodated within the interspace between the additional bendable section 31 and the 1st section 1. These may be attached either to the rear side of the 1st section 1 or to the rear side of the additional bendable section 31.

Figure 4B:
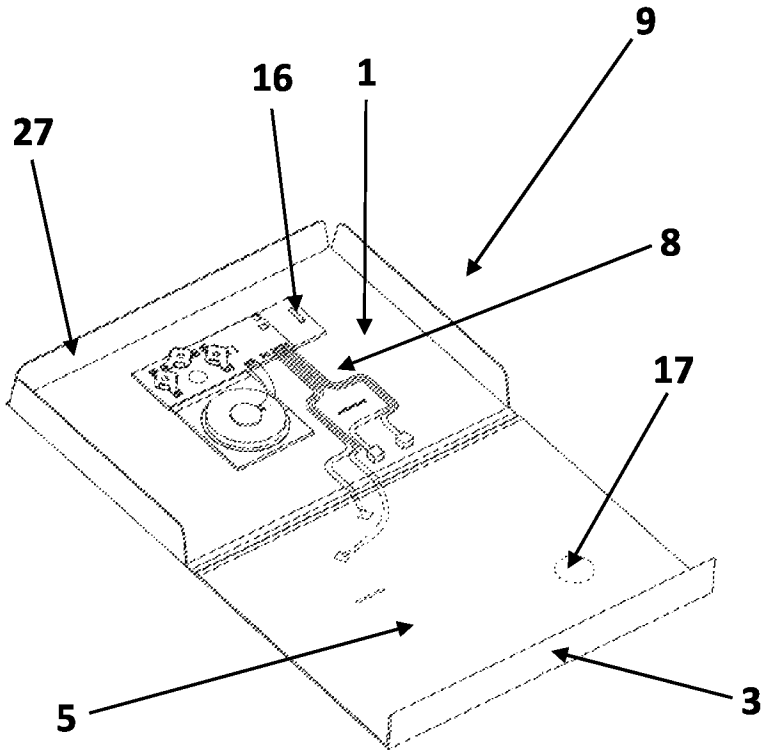
FIG. 4*b* shows the insertion sheet in the folded state as viewed from below with means for generating visual and/or acoustic effects in accordance with a second embodiment.
Figure 4A:
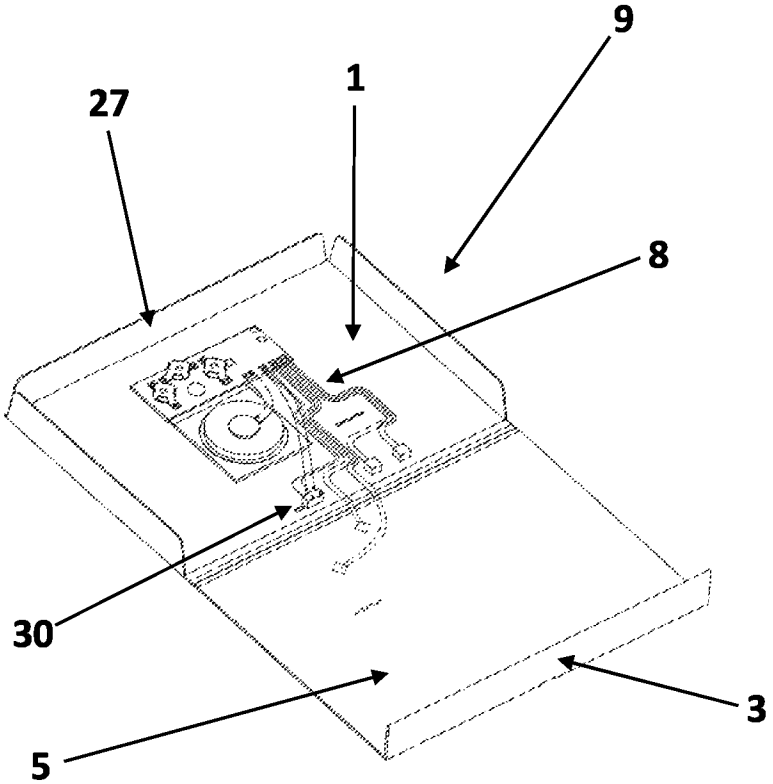
FIG. 4*a* illustrates the insertion sheet in the folded state as viewed from below with means for generating visual and/or acoustic effects in accordance with a first embodiment.

In FIG. 4*a*, insert sheet 9 is shown in a view from below with means 8 for creating visual/acoustic effects. A switch 30 which projects through the opening 18 shown hereinbefore is used to cause activation or deactivation of the means 8 by opening or closing the lid 12.

In FIG. 4*b* a respective insert sheet 9 is illustrated which differs from the embodiment shown in FIG. 4*a* as far as the activation of the means 8 for producing the visual/acoustic effects is concerned, in that a reed contact 16 is provided here which interacts with a magnet 17. In both cases, means 8 for producing the visual/acoustic effects are arranged on the reverse side of the 1st section 1, and the same applies to the reed contact 16, with magnet 17, on the other hand, being located between the 2nd and 5th sections 2, 5.

Figure 4C:
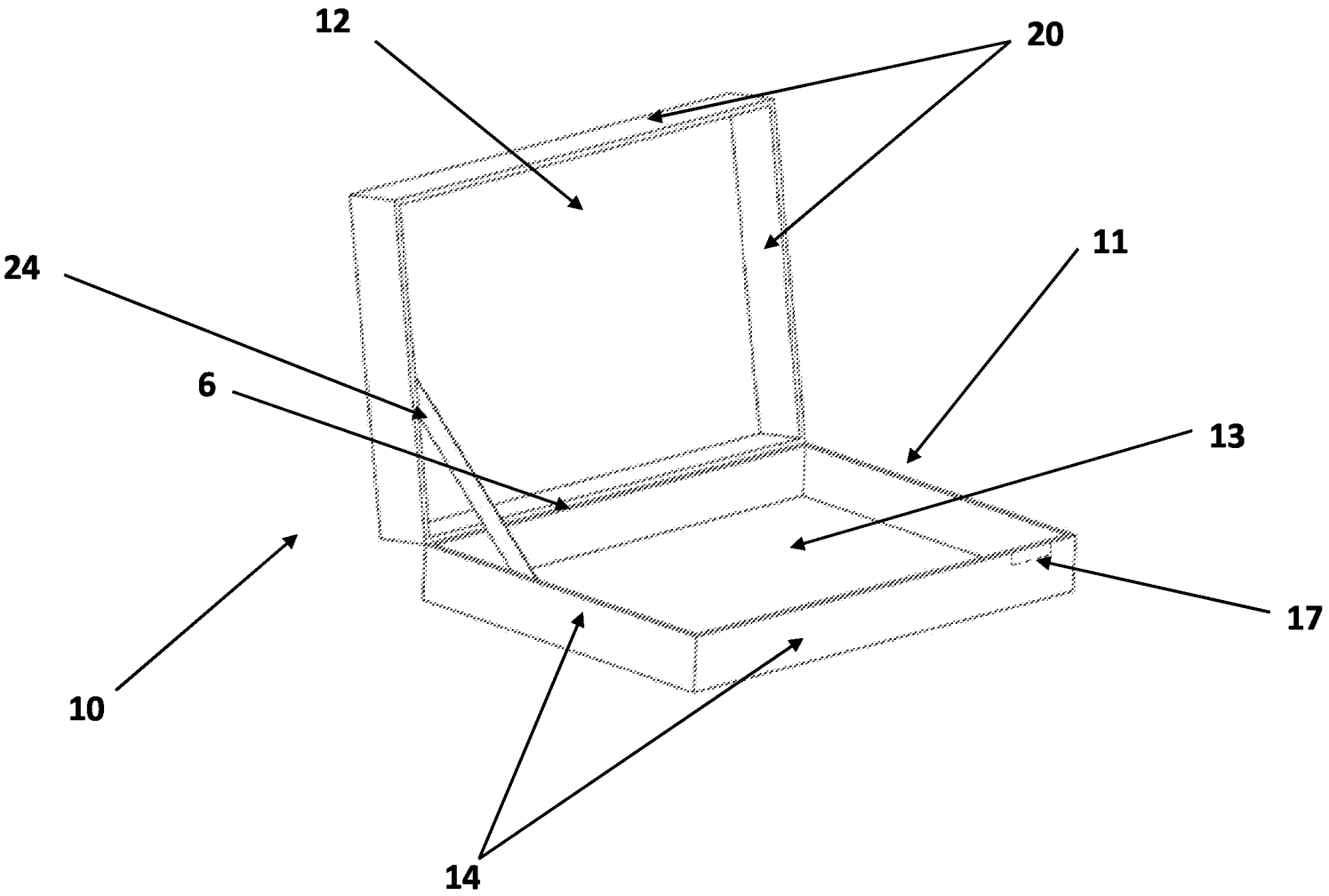
FIG. 4*c* illustrates an oblique view of the container with an alternative positioning of the magnet.

According to the embodiment in FIG. 4*c* the magnet 17 is located at an opening edge of the side wall 14. On opening the lid 12 the means 8 for producing the visual/acoustic effects are activated.

Figure 5B:
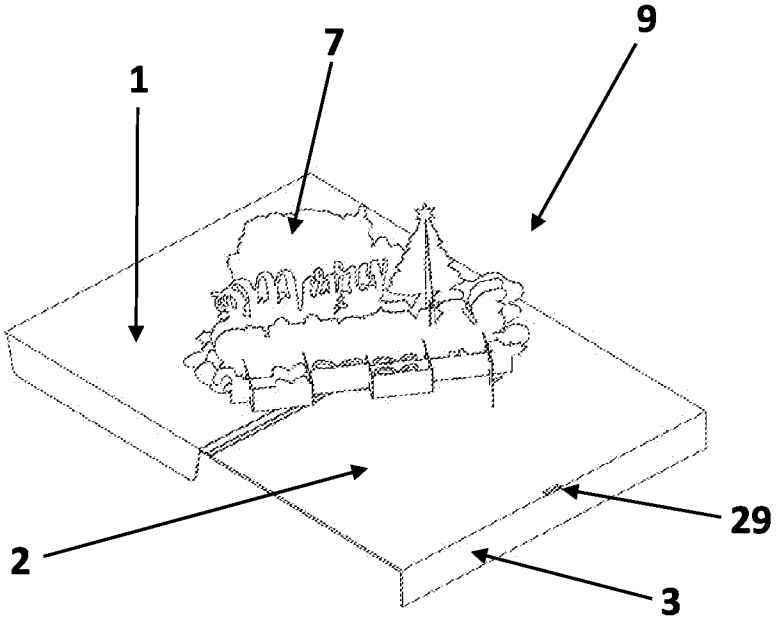
FIG. 5*b* is a top view of the insert sheet in the folded state showing the unfoldable figure.
Figure 5A:
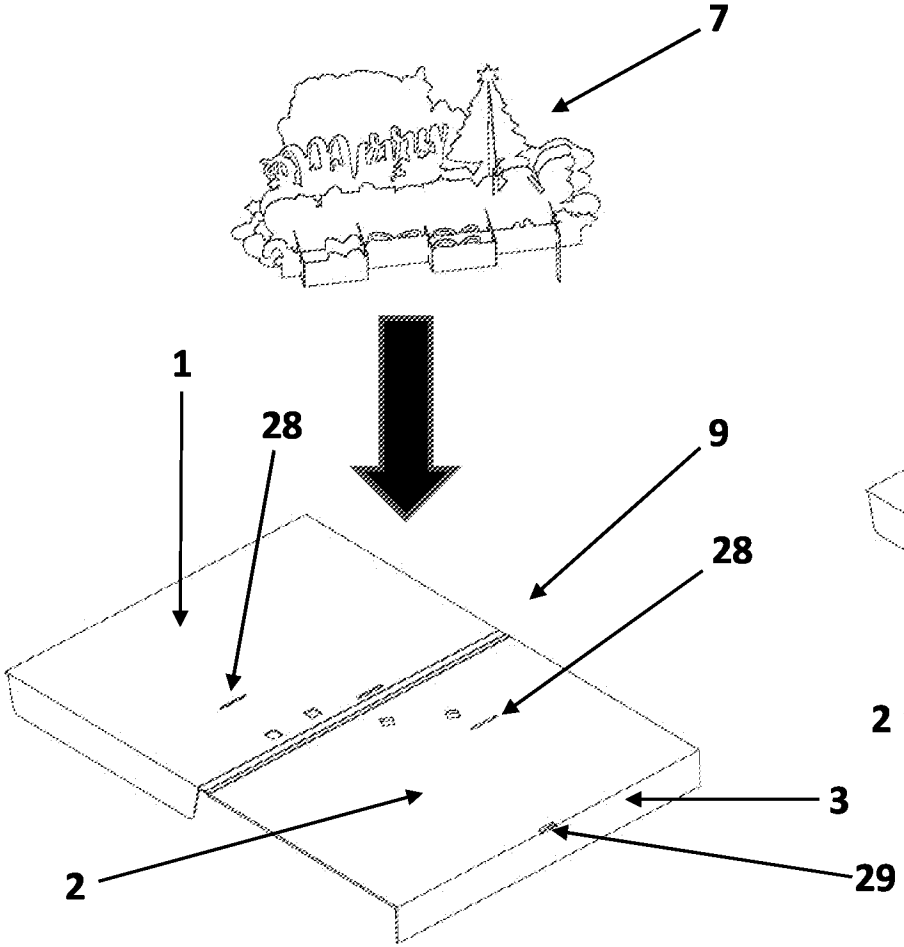
FIG. 5*a* is a top view of the insert sheet in the folded state when placing the unfoldable figure in position.
Figure 7:
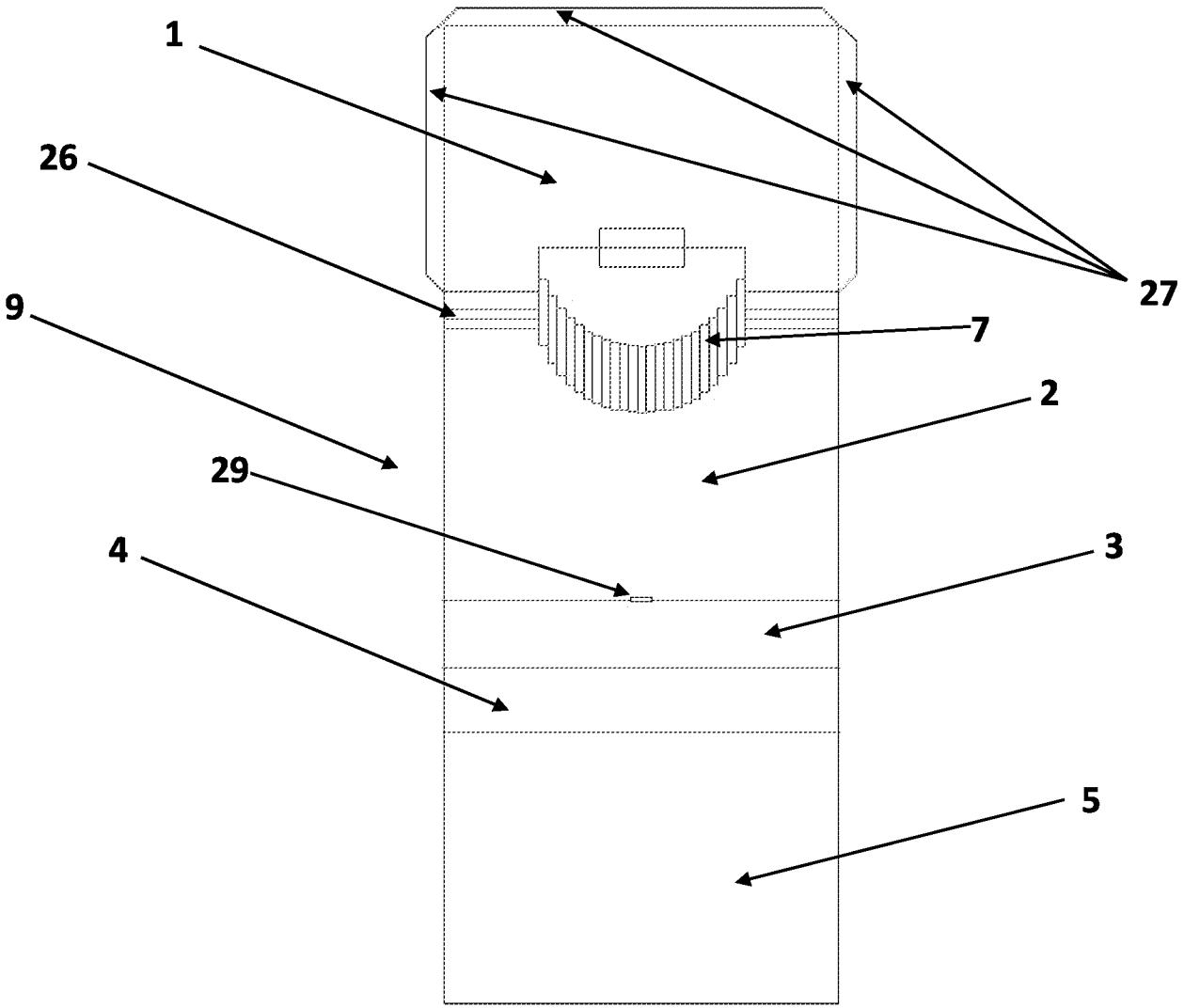
FIG. 7 depicts a top view of the insert sheet in the unfolded state according to an alternative embodiment.

FIG. 5*a* illustrates how the unfoldable FIG. 7 is mounted on the insert sheet 9 as indicated by the arrow. The unfoldable FIG. 7 is placed between the 1st and 2nd sections 1, 2 in such a way that unfolding takes place automatically upon unfolding the 1st and 2nd sections 1, 2, which is done in inserted state by opening the lid 12. The cutouts 28 already mentioned hereinbefore are provided for securing the unfoldable FIG. 7.

In FIG. 5*b* the insert sheet 9 is shown with the unfoldable FIG. 7 in secured position. The figure is caused to unfold upon the container 10 being opened, resulting in the 1st and 2nd sections 1, 2 being moved apart automatically. When the container 10 is closed, on the other hand, the 1st and 2nd sections 1, 2 are moved towards each other so that the FIG. 7 changes to assume a flat, compressed shape.

Figure 6B:
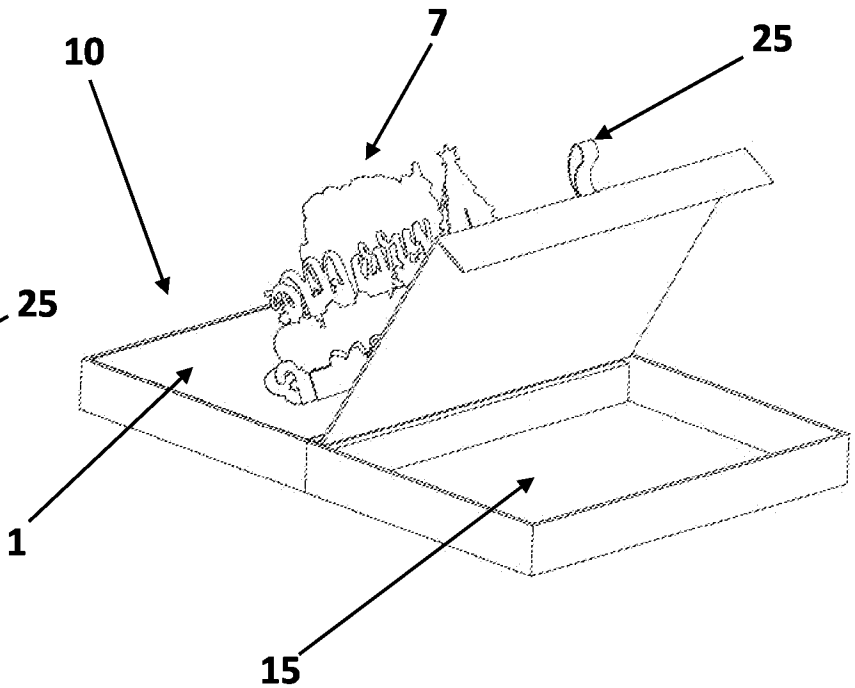
FIG. 6*b* shows the container in the top view with unfoldable figure and open compartment for the accommodation of objects.
Figure 6A:
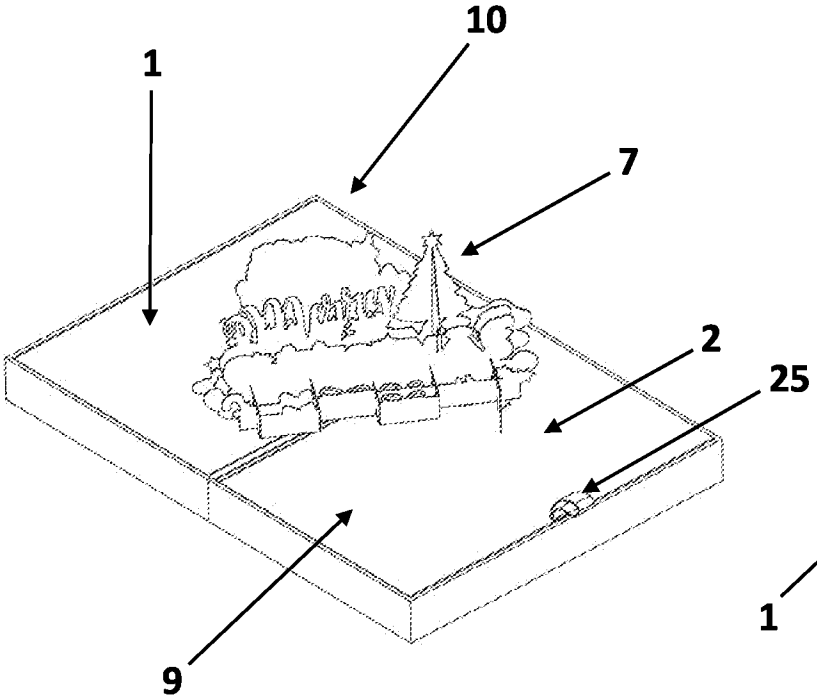
FIG. 6*a* is a top view of the container with unfoldable figure.

FIG. 6*a* shows the insert sheet 9 placed into the container 10 with the FIG. 7 in unfolded state. As shown in FIG. 6*b*, by lifting the pulling element 25, which is attached to the 2nd section 2, the compartment 15 can be opened to receive objects.

Similar to FIG. 2, an insert sheet 9 is shown in the unfolded state in FIG. 7, with the unfoldable FIG. 7 in this case, however, being already formed out on the insert sheet 9. The unfoldable FIG. 7 is produced here by a punching/die-cutting process.

Figure 8B:
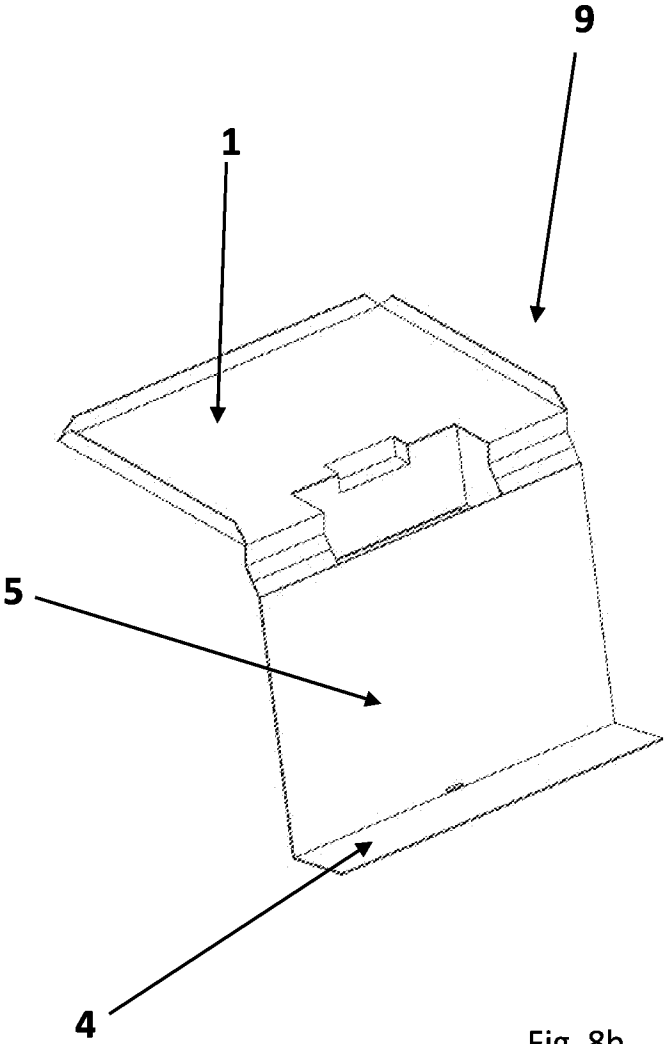
FIG. 8*b* shows the insert sheet in the folded state in the view from below as per the alternative embodiment.
Figure 8A:
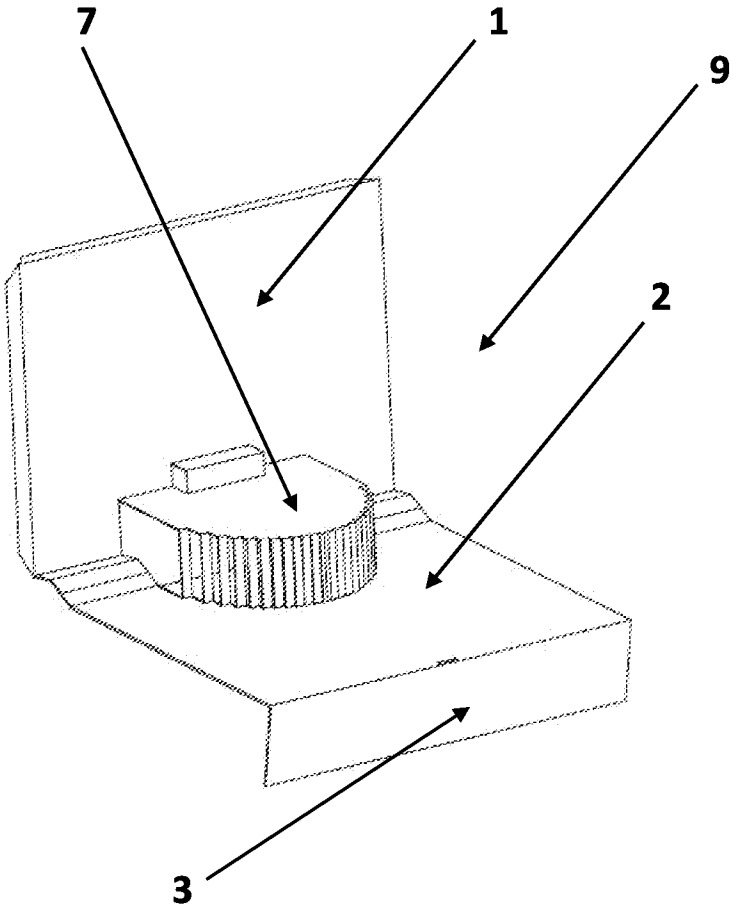
FIG. 8*a* is a top view of the insert sheet in the folded state as per the alternative embodiment.

In FIG. 8*a* the insert sheet 9 of FIG. 7 is shown in the folded state from the upper side, in FIG. 8*b* from the lower side, with in the configuration depicted here, which corresponds to the configuration when lid 12 of the container 10 has been opened, an unfolding of FIG. 7 taking place automatically.

Figure 9B:
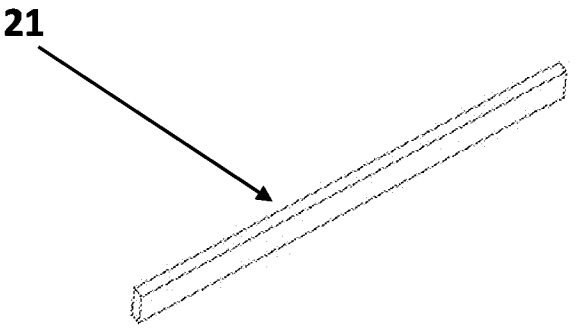
FIG. 9*b* shows a reinforcing strip for the main body.
Figure 9A:
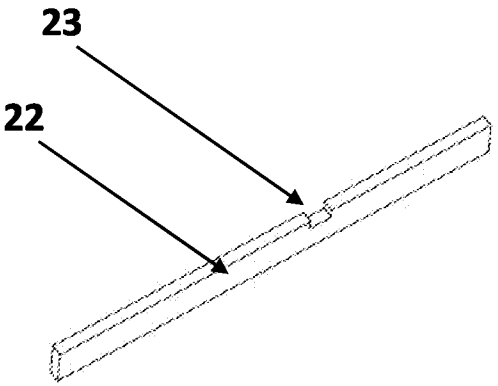
FIG. 9*a* shows a reinforcing strip for the lid.
Figure 9C:
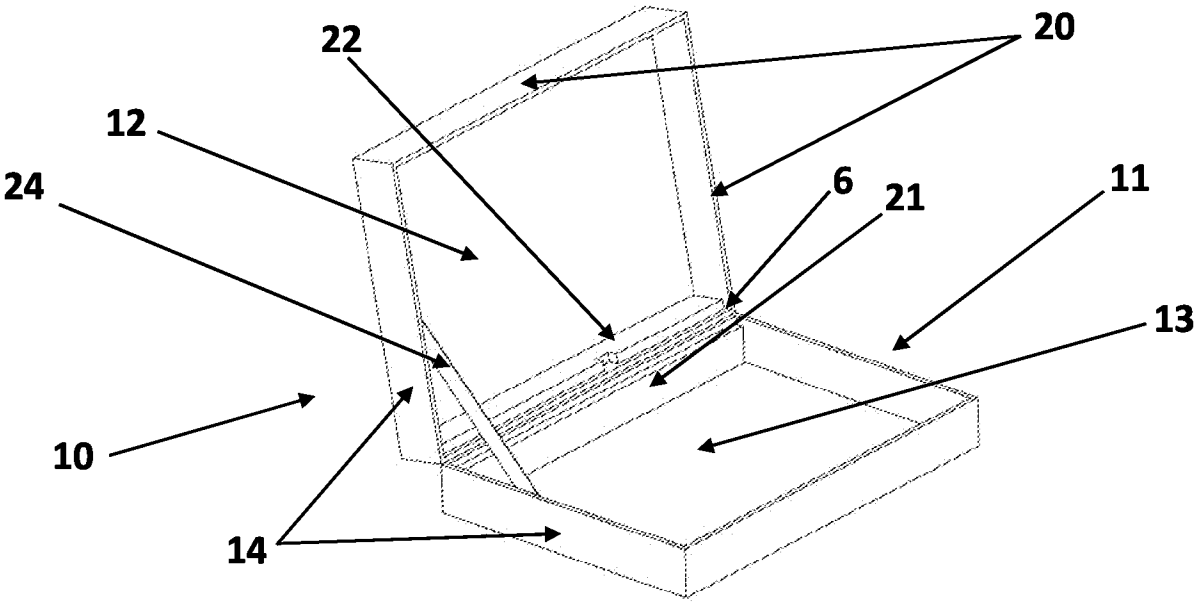
FIG. 9*c* illustrates a container proposed by the invention with reinforcing strip placed in position.

FIG. 9*a* illustrates a reinforcing strip 22 for insertion into the lid 12 along the connecting edge 6, and FIG. 9*b* shows a reinforcing strip 21 for insertion into the main body 11, also along the connecting edge 6. The situation with strips in place can be seen from FIG. 9*c*. In the reinforcing strip 22 for the lid 12 a recess 23 is arranged through which a switch projects, which interacts with the reinforcing strip 21 for the main body 11 to activate or deactivate the means 8 for producing the visual/acoustic effects upon opening or closing of lid 12.

Figure 10:
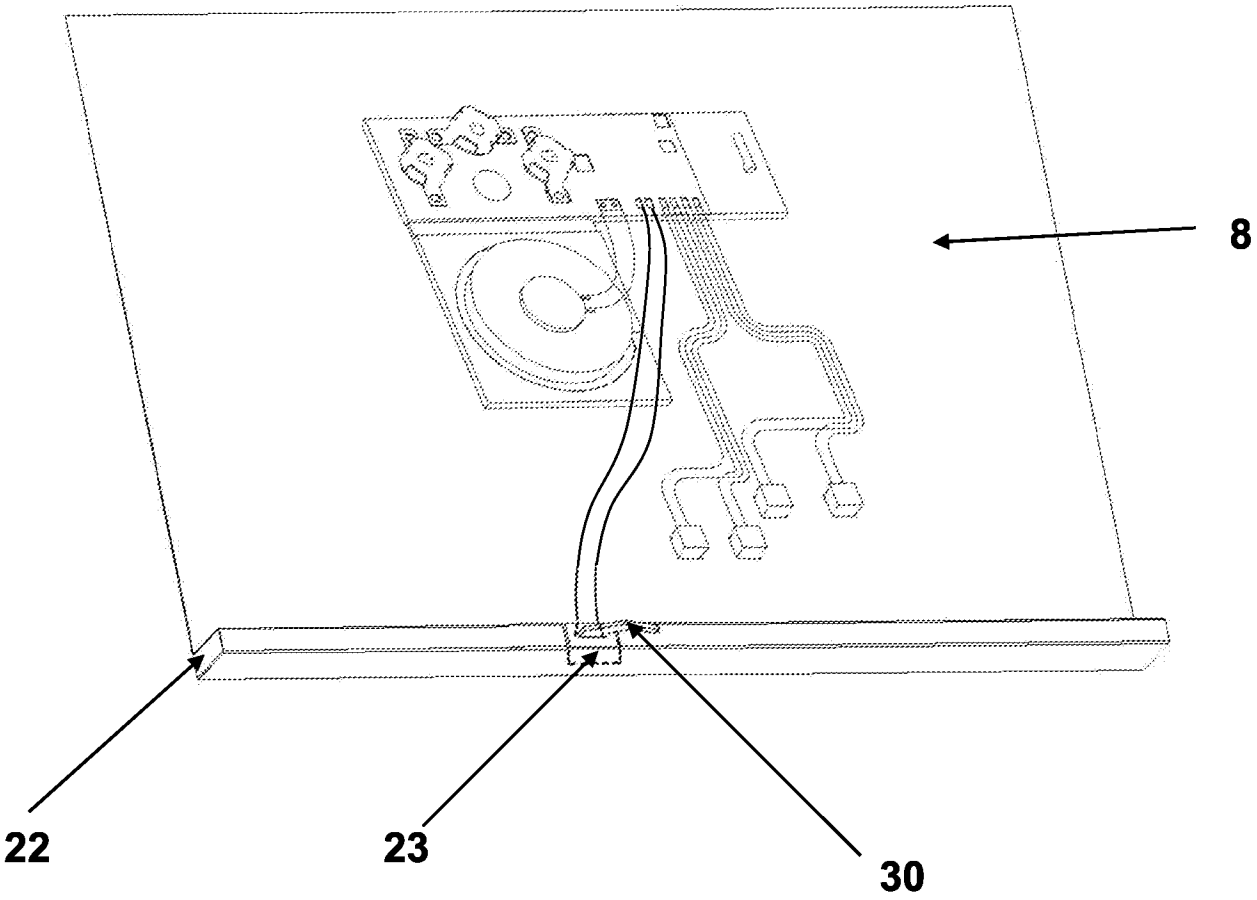
FIG. 10 shows an L-shape insert comprising electronic components to be placed within the lid.

FIG. 10 shows an L-shape insert wherein the reinforcing strip 22 is part of the L-shape insert. Within the reinforcing strip 22 a recess or cutout is arranged for accommodation of a switch 30. The electronic components of the container like the means 8 for producing the visual/acoustic effects, a PCBA are attached to the L-shape insert.

What is claimed is:

1. A container, comprising:

a main body, a lid, and a foldable insert sheet comprising at least five sections longitudinally arranged one behind the other wherein the main body being provided with a bottom as well as side walls forming a border structure pointing towards the lid, the container further having a connecting edge where the main body and the lid are joined to each other in a pivotable manner, with the container comprising a securable figure that can be secured to the foldable insert sheet and reversibly transferred from a compressed flat state to a three-dimensional expanded state, and one or more electronic components generating visual or acoustic effects, the container comprising the foldable insert sheet, wherein the 1st section covers the inside of the lid, the 2nd and 5th sections are placed on top of each other in the main body and the 3rd and 4th sections are laid one on top of the other against the inside of the side wall opposite to the connecting edge, with a compartment configured for housing one or more objects between the bottom and the 2nd and 5th sections placed on top of one another, with the one or more electronic components for producing visual or acoustic effects being located between the inside of the lid and the 1st section, and the securable figure being arranged between the 1st and 2nd sections.

2. The container according to claim 1, wherein the container is of cuboidal shape.

3. The container according to claim 1, wherein the foldable insert sheet is made of paper or cardboard material.

4. The container according to claim 1, wherein the 1st section of the foldable insert sheet is at least partially bonded to the inside of the lid.

5. The container according to claim 1, wherein the 1st section comprises an opening through which a switch protrudes, said switch activates and deactivates the one or more electronic components for producing the visual or acoustic effects when the container is opened and closed.

6. The container according to claim 1, wherein a reed contact is arranged between the 1st section and the inside of the lid and a magnet is arranged between the 2nd and 5th sections, or a reed contact is arranged between the 2nd and 5th sections and a magnet is arranged between the 1st section and the inside of the lid, wherein the reed contact activates and deactivates the one or more electronic components for generating visual or acoustic effects when the container is opened and closed.

7. The container according to claim 1, wherein between the 1st section and the inside of the lid or between the 2nd and 5th sections, some of the one or more electronic components are configured for illuminating and are in electrical connection with other of the one or more electronic components, with the 1st or the 2nd section comprising cutouts that allow the light generated by the some of the one or more electronic components to pass through.

8. The container according to claim 1, wherein the 1st section comprising foldable areas wherein an additional bendable section abuts against the top side foldable area.

9. The container according to claim 8, wherein the one or more electronic components for generating visual or acoustic effects are attached to the rear side of the additional bendable section.

10. The container according to claim 1, wherein cutouts are arranged in the 1st and 2nd sections for the fixation of the securable figure.

11. The container according to claim 1, wherein between the 1st and 2nd sections there are areas of the insert sheet that facilitate the folding of the insert sheet.

12. The container according to claim 1, wherein the lid has side walls forming a border structure pointing towards the bottom.

13. The container according to claim 1, wherein reinforcing strips are placed into the lid and in the main body respectively adjacent to and in parallel with the connecting edge.

14. The container according to claim 13, wherein the reinforcing strip placed in the lid comprising a cutout through which a switch protrudes, said switch activates and deactivates the one or more electronic components for producing visual or acoustic effects when the container is opened and closed.

15. The container according to claim 13, wherein the reinforcing strip placed in the lid is part of an insert carrying the one or more electronic components for producing visual or acoustic effects, wherein the insert is fixed inside the lid.

16. The container according to claim 1, wherein a band or a cord is attached between the lid and the main body limiting the opening angle of the container.

17. The container according to claim 1, wherein the connecting edge comprises at least one hinge.

18. The container according to claim 1, wherein a reinforcing sheet is inserted between the 2nd and 5th sections.

19. The container according to claim 1, wherein a pulling element is attached to the 2nd or 3rd section for opening the compartment.

20. The container according to claim 1, wherein the one or more electronic components are provided to bring about motion effects.

* * * * *